United States Patent [19]

Woitowitz

[11] 4,202,407

[45] May 13, 1980

[54] APPARATUS FOR COOLING GASES FROM COKE PLANTS

[75] Inventor: Friedhelm Woitowitz, Hattingen, Fed. Rep. of Germany

[73] Assignee: Didier Engineering GmbH, Essen, Fed. Rep. of Germany

[21] Appl. No.: 927,042

[22] Filed: Jul. 24, 1978

[51] Int. Cl.[2] ..... F28F 9/26

[52] U.S. Cl. ..... 165/76; 165/145; 165/176

[58] Field of Search ..... 165/176, 145, 137, 76, 165/143, 175, 157, 158

[56] References Cited

U.S. PATENT DOCUMENTS

| | | | |
|---|---|---|---|
| 1,990,541 | 2/1935 | Fugle | 165/145 |
| 2,044,457 | 6/1936 | Young | 165/176 |
| 2,193,309 | 3/1940 | Wheless | 165/76 |
| 2,821,369 | 1/1958 | Hilliard | 165/145 |
| 3,227,209 | 1/1966 | Jacobs | 165/145 |
| 3,499,484 | 3/1970 | Lanzoni | 165/176 |
| 3,991,823 | 11/1976 | Litke et al. | 165/145 |

FOREIGN PATENT DOCUMENTS

| | | | |
|---|---|---|---|
| 444047 | 4/1925 | Fed. Rep. of Germany | 165/158 |
| 823145 | 10/1951 | Fed. Rep. of Germany | 165/176 |
| 515625 | 4/1921 | France | 165/76 |
| 12026 | 10/1924 | Netherlands | 165/145 |

*Primary Examiner*—Sheldon Richter

*Attorney, Agent, or Firm*—Wenderoth, Lind & Ponack

[57] ABSTRACT

A base housing section, a plurality of intermediate housing sections, and a head housing section are stacked one above the other in a gas-tight but readily removable manner, to form a hollow housing. The base housing section and head housing section are equipped with gas connections so that a gas from a coke plant may be circulated through the hollow housing. Each intermediate housing section has extending transversely across the interior thereof at least one group of a plurality of heat exchange tubes. Cooling fluid connection means are connected to the uppermost and lowermost groups of tubes for the passage therethrough of a cooling fluid. Adjacent ends of adjacent groups of the tubes are connected such that the heat exchange fluid passes through all of the tubes of the intermediate housing sections in a substantially sinusoidal manner.

8 Claims, 4 Drawing Figures

APPARATUS FOR COOLING GASES FROM COKE PLANTS

BACKGROUND OF THE INVENTION

The present invention relates to a heat exchange apparatus, and particularly to a cooling apparatus for cooling gases from coke plants.

More particularly, the present invention is directed to such an apparatus including a substantially quadrangular, vertically extending housing having cooling tubes extending transversely thereof. The cooling tubes are arranged throughout the entire height of the housing and are traversed by a cooling agent. A flow of gas from a coke plant passes outwardly of the tubes in a longitudinal direction through the housing, whereby the gas is cooled.

Heat exchangers of the above type are known, whereby the housing is formed by a pair of spaced side walls and a pair of spaced tube plates or end walls which are joined at opposite ends thereof to the side walls. The side walls and tube plates extend throughout the entire height of the housing. Tubes extend across the interior of the housing and extend through the tube plates to the exterior of the housing. The tubes are arranged in vertically spaced groups, and on the outer sides of the tube plates are attached dome-shaped chambers in the form of detachable covers which operate to guide the cooling fluid from the ends of the tubes of one group to the adjacent ends of the tubes of an adjacent group.

Cooling apparatuses of this type often have a total height of more than twenty meters, and the horizontal cross-section of the interior of the housing may be substantial, for example up to twelve square meters or more. Furthermore, in cooling apparatuses of this type, as much as approximately twenty-five kilometers of tubing are employed as the cooling tubes. Therefore, the total weight of the cooling apparatus is so great that, in order to reduce the weight of the apparatus as much as possible during transportation thereof, the cooling tubes are assembled into the cooling apparatus only at the place or location of intended use of the apparatus. This however requires a very expensive scaffolding system at the place of use, due to the great height of the apparatus, for assembling of the tubes to the following apparatus. Such scaffolding apparatus is of course also necessary when it becomes necessary to replace or repair any of the tubes.

Additionally, due to the great weight and considerable length of the cooling apparatus, there occur considerable difficulties in transporting the entire cooler.

SUMMARY OF THE INVENTION

With the above discussion in mind, it is an object of the present invention to provide an improved heat exchanger apparatus of the above described type.

More particularly, it is an object of the present invention to provide such an improved heat exchanger apparatus whereby the manufacture, transportation and assembly of the apparatus are simplified and reduced in cost.

These objects are achieved in accordance with the present invention by providing that the housing of the heat exchanger apparatus includes a base housing section having a hollow interior, an upper open end, and gas connection means, for example a gas inlet, opening into the interior. The housing also includes a head or upper housing section having a hollow interior, an open lower end, and a gas connection, for example a gas outlet, opening into the interior. The housing also includes a plurality of separate hollow intermediate housing sections which can be stacked one above the other, in a gas-tight but readily removable manner, between the base housing section and the head housing section. All of the intermediate housing sections have open upper and lower ends, such that the interiors of the intermediate housing sections are in alignment and in open communication with the interiors of the base housing section and the head housing section. Each intermediate housing section has extending transversely across the interior thereof at least one group of a plurality of heat exchange tubes, the interiors of the tubes being isolated from the interior of the housing. Heat exchange fluid connections are joined to the uppermost and lowermost of the groups of tubes, such that heat exchange fluid, for example a cooling fluid, may be supplied to the ends of the uppermost or lowermost group of tubes, and such that such heat exchange fluid may be discharged from the ends of the lowermost or uppermost group of tubes. Connecting means are provided adjacent ends of adjacent of the groups of tubes, such that the heat exchange fluid passes through the tubes of the intermediate housing sections throughout the entire height of the housing in a substantially sinusoidal manner or path.

By providing the housing from a plurality of separable sections, the heat exchange apparatus may be readily broken down into separate housing sections each weighing much less than the entire heat exchange apparatus of the prior art. Thereby, the separate sections of the overall heat exchanger apparatus can be transported much more easily and simply than has been possible in the prior art. Also, each intermediate housing section may be provided with the respective cooling tubes thereof in the manufacturing plant. Therefore, it is not necessary to assemble the cooling tubes to the housing at the place of utilization, as has been necessary in prior art installation. In the event that cooling tubes of a particular intermediate housing section need to be replaced or repaired, such particular intermediate housing section may be easily removed from the overall heat exchanger apparatus and placed at ground level. Accordingly, the expensive scaffolding apparatus required in the prior art is no longer necessary in accordance with the improved heat exchanger apparatus of the present invention.

The separate housing sections of the apparatus of the present invention can be simply and easily assembled at a location of use by means of a readily available and conventional device, such as a crane. Furthermore, due to the fact that the heat exchanger apparatus of the present invention includes a plurality of separable housing sections, the overall heat exchanger apparatus may be adapted to a particular installation or requirements by merely increasing or decreasing the number of intermediate housing sections employed.

In accordance with an advantageous feature of the present invention, the base housing section, the head housing section, and the intermediate housing sections have substantially identical horizontal configurations or profiles. Specifically, the interiors of all of the housing sections have substantially identical horizontal cross-sectional configurations, preferably rectangular.

In accordance with a preferred feature of the present invention, the various housing sections may be joined to each other in a pressure-tight but readily separable manner merely by the weight of the upper of the sections resting on the lower of the sections by gravity.

In accordance with a still further feature of the present invention, the various sections are provided with generally vertically extending plug-in alignment or connection elements which aid in accurately vertically aligning the sections with respect to each other.

In accordance with a specifically preferred embodiment of the present invention, each intermediate housing section is formed by a pair of spaced side walls and a pair of spaced tube plates having opposite ends attached to the side walls. The cooling tubes extend between the tube plates, and opposite ends of the tubes extend through the tube plates. The side walls each have portions extending beyond the tube plates. End walls are attached in a pressure-tight and detachable manner to the opposite ends of the side walls. Thus, the end plates, the tube plates and such portions of the side walls together form vertically extending ducts which communicate with opposite ends of the tubes. Such ducts form connections which communicate adjacent ends of adjacent groups of the tubes. In a further preferred embodiment, each intermediate housing section includes two groups of tubes, with one group spaced vertically above the other group. The vertically extending ducts at one end of the heat exchanger apparatus are each divided into two separate ducts by transverse partitions which are positioned at levels between the two groups of tubes of the respective intermediate housing sections. Thereby, the heat exchange fluid passes in opposite substantially horizontal directions in each intermediate housing section.

In accordance with a further feature of the present invention, the upper end of the base housing section, the lower end of the head housing section, and the upper and lower ends of all of the intermediate housing sections have inwardly extending flanges adapted to face each other when the sections are stacked one above the other. Such flanges increase the rigidity of the heat exchanger apparatus, and such flanges also act as sealing surfaces to ensure pressure-tight connection between adjacent housing sections. In this regard, seals may be positioned between mutually facing flanges of adjacent housing sections.

In accordance with an even further feature of the present invention, reinforcing bars, preferably horizontally extending, may be attached to the exteriors of the walls of the housing sections. Such reinforcing bars may include couplings for attachment to a lifting device for the selective lifting and lowering of the intermediate housing sections. Such reinforcing bars also may be associated with climbing steps or ladders to facilitate access to the entire height of the heat exchanger apparatus.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

The following description will be with reference to a specifically preferred embodiment of the heat exchanger apparatus of the present invention, and specifically employed as a cooling apparatus for cooling gases from a coke oven plant. It is specifically to be understood however that the heat exchanger apparatus of the present invention may be employed for other heat exchange purposes and may be directed to other specific structural configurations than described and illustrated herein.

Figure 1:
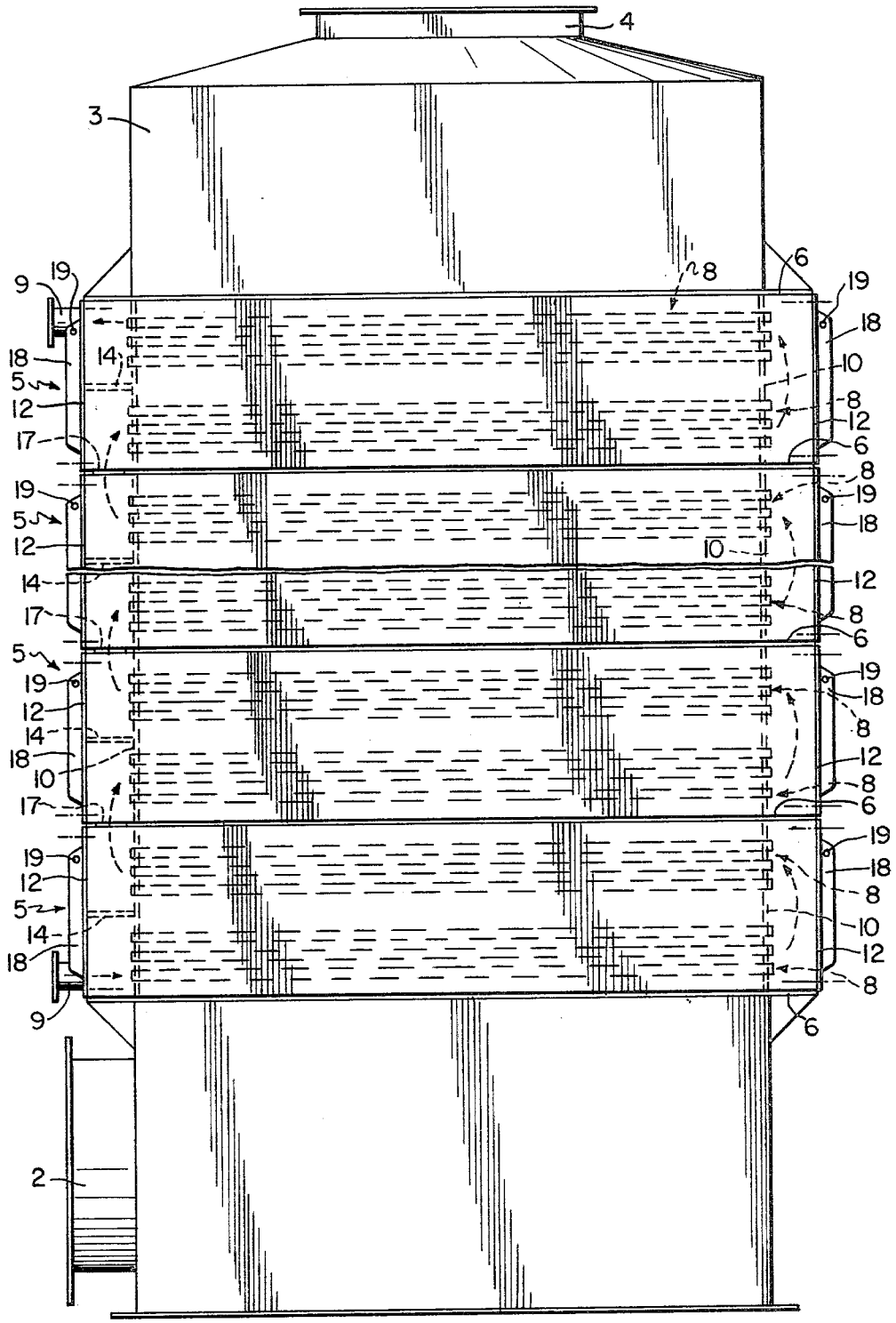
FIG. 1 is a front elevation view of one embodiment of a heat exchanger apparatus in accordance with the present invention.

The overall heat exchanger apparatus includes a base housing section 1, a top or head housing section 3, and a plurality of intermediate housing sections 5. The base housing section 1 is provided with a gas connection 2, for example an inlet for coke plant gases to be cooled. Head housing section 3 is also provided with a gas connection 4, for example an outlet for cooled coke plant gases. The various housing sections are stacked one above the other, in the manner shown in FIG. 1 so as to provide gas-tight and pressure-tight connections between adjacent housing sections. Seals 6 may be provided between adjacent housing sections, as shown in FIG. 1, to facilitate the gas-tight and pressure-tight connections. The interiors of all of the housing sections have substantially the same horizontal configuration so that the interior of the overall housing is continuous, as will be apparent from a consideration of FIG. 1.

Each intermediate housing section 5 has extending transversely, i.e. substantially horizontally, across the interior thereof at least one group of cooling tubes 8. In the illustrated embodiment, each intermediate housing section 5 has two groups 8 of cooling tubes. It is specifically to be understood however that it is intended to be within the scope of the present invention that each intermediate housing section 5 may have only a single group 8 of cooling tubes or more than two groups 8 of cooling tubes. As shown in FIG. 1, the uppermost and lowermost groups of cooling tubes are joined to heat exchange fluid connections 9. For example, in the illustrated arrangement, lowermost connection 9 is a cooling fluid inlet for supplying cooling fluid to one of the ends of each of the cooling tubes of the lowermost group of cooling tubes. Similarly, uppermost connection 9 is a cooling fluid outlet for discharging cooling fluid from one of the ends of each of the tubes of the uppermost group of tubes.

Further in accordance with the present invention, each intermediate housing section 5 includes connecting ducts, to be discussed in more detail below, for connecting the discharge ends of one group of cooling tubes with the inlet ends of the next adjacent group of cooling tubes. Thereby, the cooling fluid passes through all of the tubes of each group of tubes in a sinusoidal manner throughout the entire height of the overall heat exchanger apparatus. That is, as will be apparent from FIG. 1 of the drawings, the cooling fluid enters through lowermost inlet connection 9 and passes through all of the tubes of the lowermost group in a first horizontal direction. The fluid is discharged from the discharge ends of the tubes of the lowermost group and is then supplied to the inlet ends of the tubes of the next higher group and passes through such tubes in an opposite horizontal direction. The fluid exits from the discharge ends of the tubes of the second group and then passes upwardly through openings 17, to be discussed in more detail below, and then passes to the inlet ends of the tubes of the next higher group of tubes in the next higher and adjacent intermediate housing section. These sinusoidal paths are continued until the cooling fluid is finally discharged from the apparatus at the upper outlet connection 9.

Figure 2:
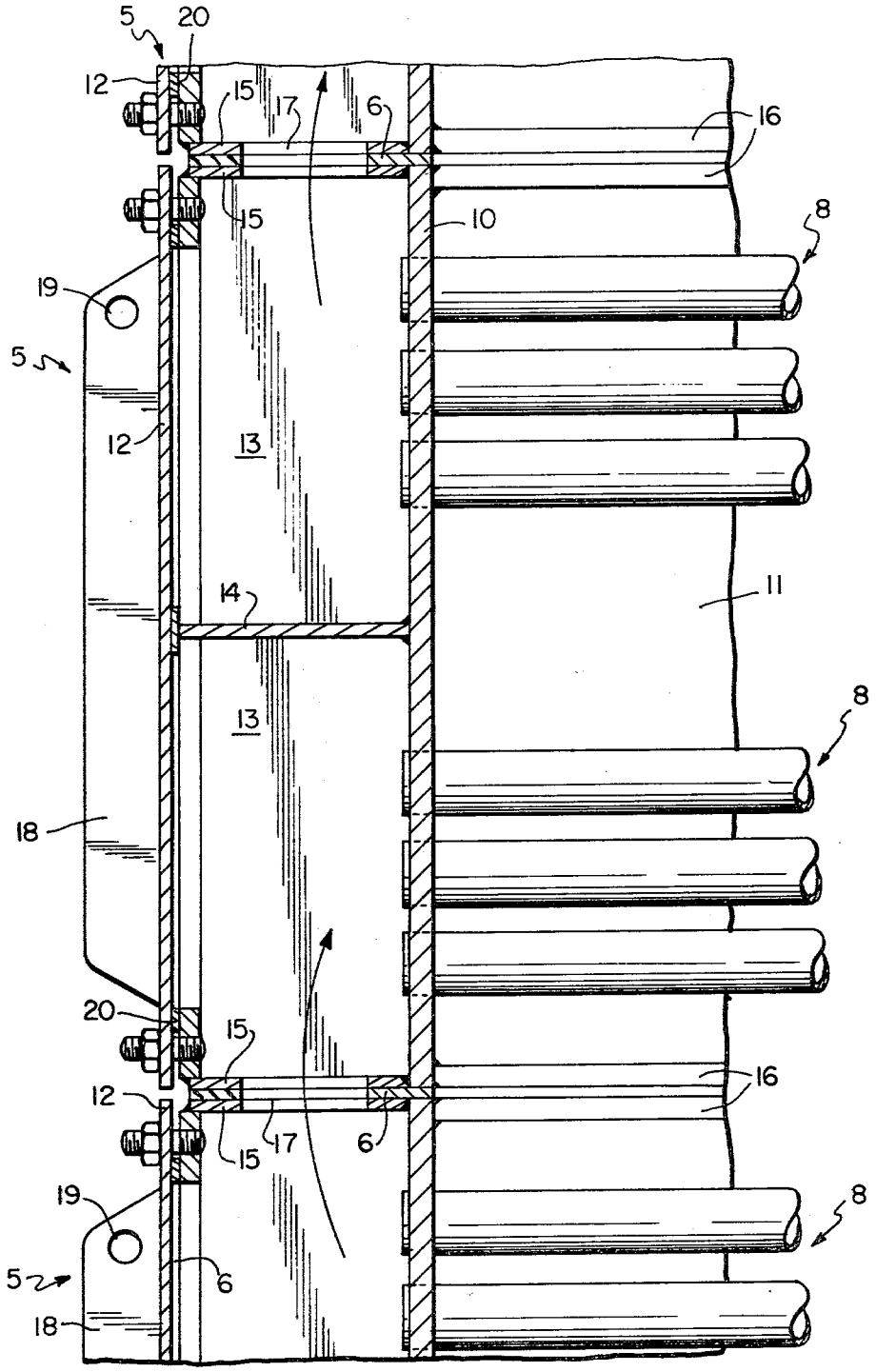
FIG. 2 is a vertical cross-section, on an enlarged scale, of a portion of the heat exchanger apparatus shown in FIG. 1.

Each intermediate housing section 5 is formed by a pair of spaced side walls 11 and a pair of spaced tube plates 10 having opposite ends attached to side walls 11. This relationship is most clearly shown in FIG. 4 of the drawings. The cooling tubes of each group 8 extend transversely across the interior of the intermediate housing section, and opposite ends of each of the cooling tubes extend through and are fixed to the tube plates 10, such that the opposite ends of the cooling tubes open exteriorly of each of the tube plate 10. Opposite lateral end portions of each of the side walls 11 extend outwardly beyond the respective tube plates 10. End walls 12 are detachably mounted, for example by means of bolts in the manner illustrated in the drawings, to the opposite ends of the side walls 11. End walls 12 extend substantially parallel to respective tube plates 10. Thus, each end wall 12, the respective tube plate 10, and the respective end portions of the side walls 11 define a substantially vertically extending duct 13, as shown most clearly in FIGS. 1 and 2 of the drawings. The ends of the cooling tubes open into the ducts 13. The end walls 12 are attached to the ends of side walls 11 in any suitable manner to ensure a gas-tight and pressure-tight seal therewith. In the illustrated embodiment this is achieved by means of seals 20, but similarly may be achieved by any other conventional means as will be apparent to those skilled in the art.

All of the vertical ducts 13 on one side of the heat exchanger apparatus, i.e. the left side as viewed in the drawings, are divided by substantially horizontally extending partitions 14. Thus the ducts 13 on one side of the heat exchanger apparatus are divided into two separate ducts for each intermediate housing section 5. Accordingly, the cooling tubes of the lower group 8 open into the lowermost duct 13, and the tubes of the uppermost group 8 open into the uppermost duct, for each intermediate housing section 5. Each duct 13 on the other end of each intermediate housing section remains unpartitioned, as will be readily apparent from FIGS. 1 and 3 of the drawings.

The lower end and the upper end of each vertical duct 13 on both ends of each intermediate housing section 5 are closed in a pressure-tight manner by a horizontal wall 15. On that side of the heat exchanger apparatus wherein the vertical ducts 13 are divided by partitions 14, i.e. on the left side as viewed in the drawings, the horizontal walls 15 have openings 17 extending therethrough. Thus, as particularly shown in FIG. 2 of the drawings, cooling fluid which is discharged from the tubes of the uppermost group 8 of a given intermediate housing section 5 may communicate through openings 17 to the tubes of the lowermost group of the next adjacent intermediate housing section 5.

In accordance with a further preferred feature of the present invention, the upper and lower ends of each side wall 11 of each intermediate housing section 5 have extending inwardly therefrom a flange 16. Flanges 16 increase the rigidity of the structure of the intermediate housing section 5. Flanges 16 also facilitate sealing contact between adjacent housing sections, and in this regard seals 6 may be provided between adjacent facing flanges 16. It will of course be understood that the upper end of base housing section 1 and the lower end of head housing section 3 may similarly be provided with inwardly extending flanges 16. In accordance with a further preferred feature of the present invention, each wall 15 may be aligned to extend at the same level as a corresponding flange 16, whereby a single seal 6, or at any rate aligned seal 6, may extend at a single level between adjacent intermediate housing sections 5.

In accordance with a further feature of the present invention, the exteriors of each intermediate housing section 5 may be provided with reinforcing bars. In the illustrated embodiment, exterior surfaces of end walls 12 have rigidly attached thereto, for example by welding, substantially vertically extending reinforcing bars 18. Bars 18 may be provided with means, for example openings 19, for coupling to a lifting device for the selective lifting and lowering of the respective intermediate housing sections. Further, reinforcing bars 18 may be conventionally provided with step or ladder structure to facilitate access to the entire height of the heat exchanger apparatus.

Figure 3:
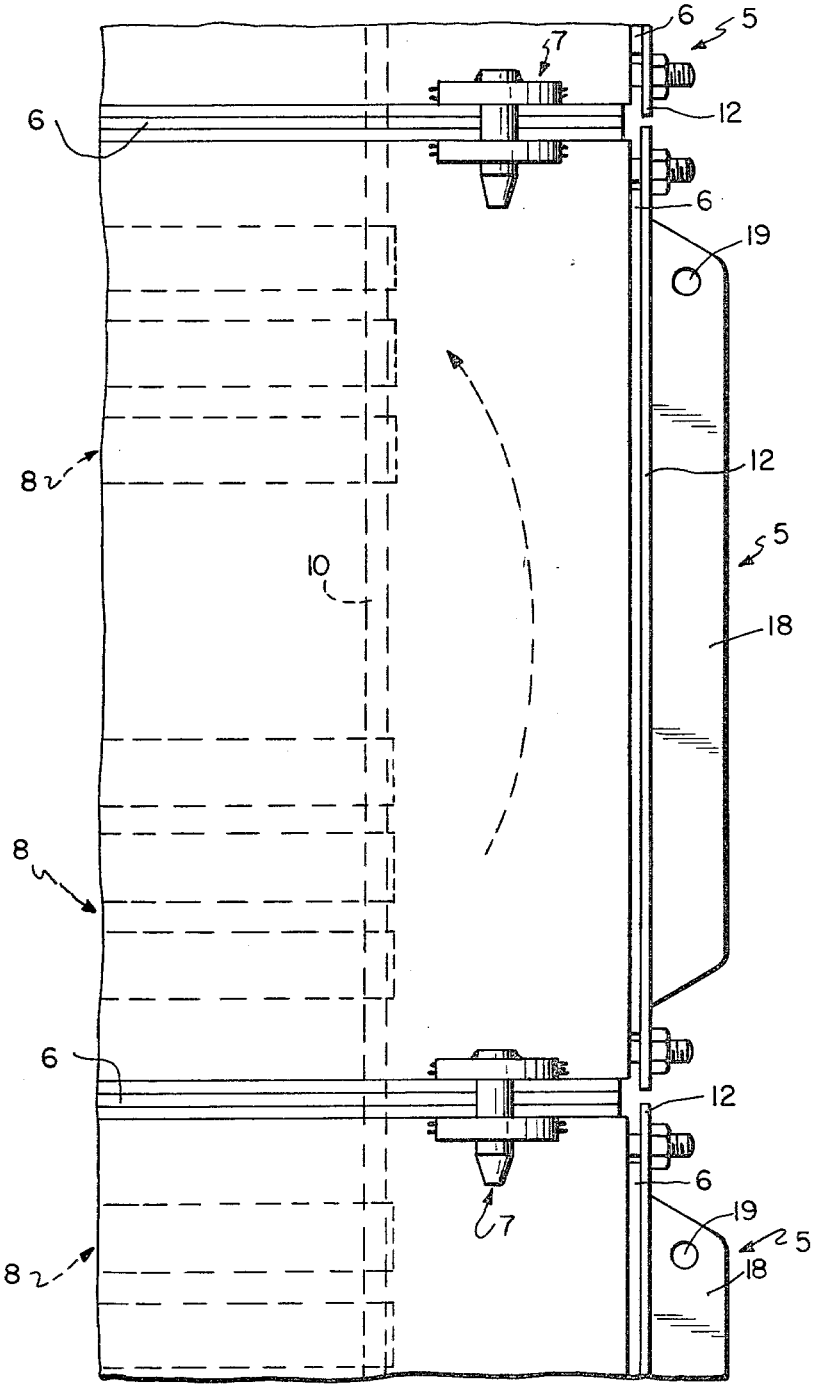
FIG. 3 is a front elevation view, on an enlarged scale, of a portion of the heat exchanger apparatus shown in FIG. 1.
Figure 4:
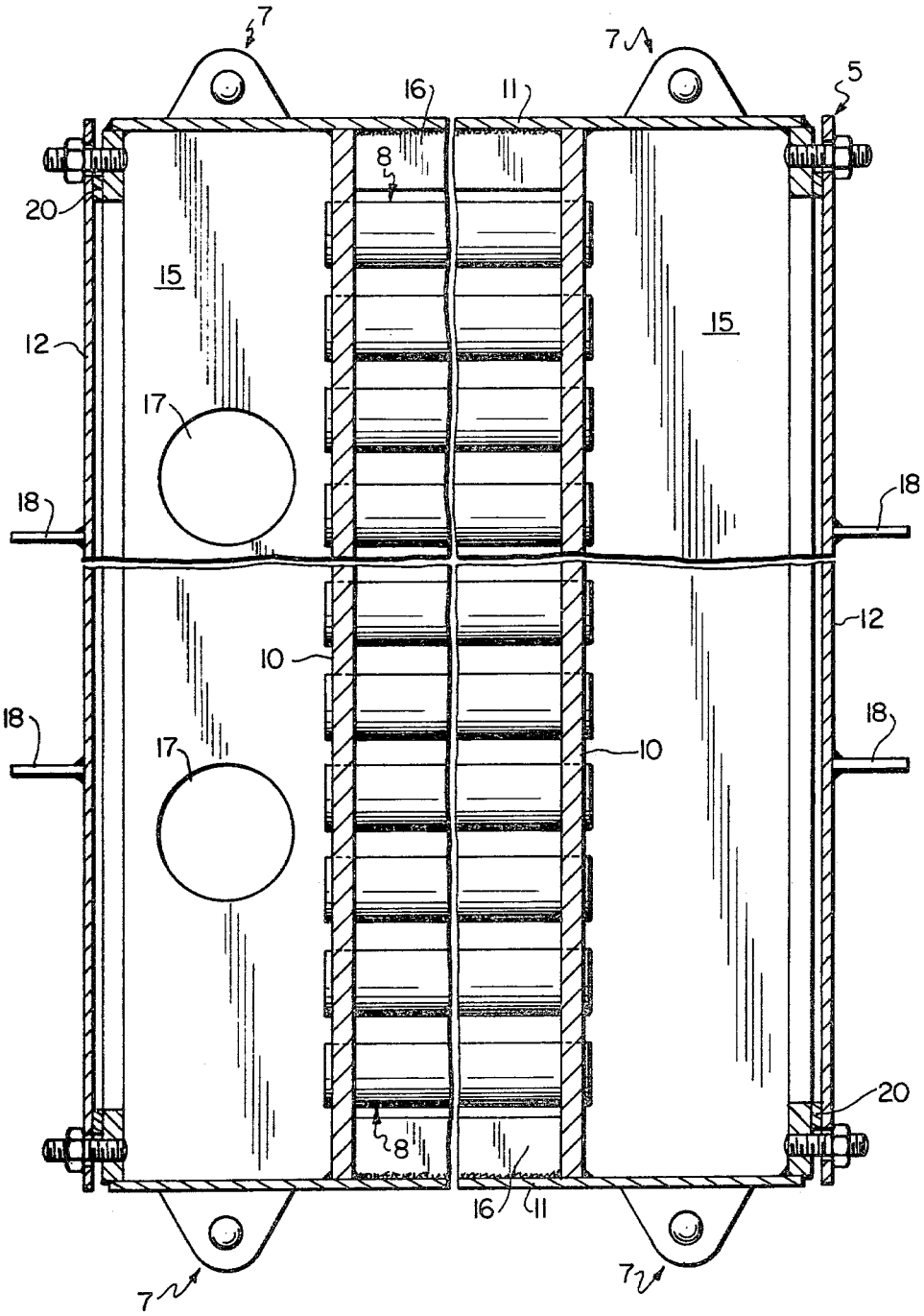
FIG. 4 is a horizontal cross-sectional view, on an enlarged scale, of the heat exchanger apparatus shown in FIG. 1.

According to a further feature of the present invention, the accurate vertical alignment of adjacent housing sections may be facilitated by generally vertically extending plug-in alignment or connection elements 7, the construction of which is clearly shown in FIGS. 3 and 4 of the drawings.

Although the present invention has been herein described and illustrated with respect to a specifically preferred embodiment thereof, it is to be understood that various modifications may be made to such specifically illustrated and described features without departing from the scope of the present invention.

What I claim is:

1. A heat exchange apparatus, particularly for use in cooling gas from coke plants, said apparatus comprising:

a base housing section having a hollow interior, an open upper end, and gas connection means opening into said interior;

a head housing section having a hollow interior, an open lower end, and gas connection means opening into said interior;

a plurality of separate hollow intermediate housing sections stacked one above the other, in a gas-tight but readily removable manner, between said base housing section and said head housing section, said head housing section, said intermediate housing sections and said base housing section being joined to each other in a pressure-tight manner solely by the weight of upper of said sections resting on lower of said sections, said intermediate housing sections having open upper and lower ends, such that the interiors of said intermediate housing sections are in alignment and in open communication with said interiors of said base housing section and said head housing section;

plug-in alignment means on said head housing section, said intermediate housing sections and said base housing section providing an accurate vertical alignment of said sections when said sections are stacked one above the other;

each said intermediate housing section having extending transversely and substantially horizontally across the interior thereof at least one group of a plurality of heat exchange tubes, the interiors of said tubes being isolated from the interiors of said intermediate housing sections;

heat exchange fluid connection means connected to the uppermost and lowermost of said groups of tubes for the passage therethrough of heat exchange fluid;

each said intermediate housing section comprising a pair of spaced side walls, a pair of spaced tube plates having opposite ends attached to said side walls, said tubes extending between said tube plates, with opposite ends of said tubes extending through said tube plates, said side walls each having portions extending beyond said tube plates, and end walls attached in a pressure-tight and detachable manner to said opposite ends of said side walls, said end walls, said tube plates and said portions of said side walls together forming vertically extending ducts at said opposite ends of said tubes; and said ducts comprising connecting means for connecting adjacent ends of adjacent of said groups of tubes such that said heat exchange fluid passes through said tubes of said intermediate housing sections in a substantially sinusoidal manner.

2. An apparatus as claimed in claim 1, wherein said base housing section, said head housing section, and said intermediate housing sections have substantially identical horizontal configurations.

3. An apparatus as claimed in claim 1, wherein each said intermediate housing section includes two vertically spaced groups of tubes, and said vertically extending duct at one end of said tubes is divided into two ducts by a transverse partition.

4. An apparatus as claimed in claim 3, wherein each said partition is positioned at a level between said two groups of tubes of the respective said intermediate housing section.

5. An apparatus as claimed in claim 1, further comprising reinforcing bars attached to the exteriors of said end walls.

6. An apparatus as claimed in claim 5, wherein said reinforcing bars include means for coupling to a lifting device for the selective lifting and lowering of said intermediate housing sections.

7. An apparatus as claimed in claim 1, wherein said upper end of said base housing section, said lower end of said head housing section, and said upper and lower ends of said intermediate housing sections have inwardly extending sealing flanges adapted to face each other when said sections are stacked one above the other.

8. An apparatus as claimed in claim 7, further comprising seal means positioned between mutually facing said flanges.

* * * * *